US010253975B2

(12) United States Patent
White et al.

(10) Patent No.: US 10,253,975 B2
(45) Date of Patent: Apr. 9, 2019

(54) TORCH WITH ELEVATED PLATFORM

(71) Applicant: Lamplight Farms Incorporated, Menomonee Falls, WI (US)

(72) Inventors: Ron White, North Prairie, WI (US); Scott Gehring, Menomonee Falls, WI (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 281 days.

(21) Appl. No.: 15/073,359

(22) Filed: Mar. 17, 2016

(65) Prior Publication Data

US 2017/0268770 A1 Sep. 21, 2017

(51) Int. Cl.

| | |
|---|---|
| ***F23D 3/18*** | (2006.01) |
| ***F23D 3/20*** | (2006.01) |
| ***F24C 3/02*** | (2006.01) |
| ***F24C 5/04*** | (2006.01) |
| *F21H 1/00* | (2006.01) |
| *F21L 17/00* | (2006.01) |
| *F24C 5/12* | (2006.01) |

(Continued)

(52) U.S. Cl.

CPC ..... *F23D 3/18* (2013.01); *F23D 3/20* (2013.01); *F24C 3/022* (2013.01); *F24C 5/04* (2013.01); *F21L 17/00* (2013.01); *F23D 3/24* (2013.01); *F23D 2202/00* (2013.01)

(58) Field of Classification Search

CPC ..... F23D 3/18; F23D 3/20; F23D 2202/00; F23D 2206/0026; F23D 2700/006; F23D 2700/002; F23D 2700/003; F23D 2900/14001; F21L 17/00; F24C 3/022; F24C 3/082; F24C 3/14; F24C 5/04; F24C 5/12; F24C 5/20; F24C 15/08; F24C 15/083; F24C 15/086; F21H 1/00

USPC ..... 431/343, 334, 102, 298; 126/512, 259 R, 126/257, 30, 29; 362/266, 365, 415

See application file for complete search history.

(56) References Cited

U.S. PATENT DOCUMENTS

| | | | |
|---|---|---|---|
| 66,021 | A | 1/1867 | Heath |
| D65,229 | S | 5/1867 | Irwin |

(Continued)

FOREIGN PATENT DOCUMENTS

| | | |
|---|---|---|
| CA | 2675817 | 10/2010 |
| CN | 2670364 | 1/2005 |

(Continued)

OTHER PUBLICATIONS

Pipe-Line Denmark, "Elipse Advanced Burning Control". Publication unknown, admitted prior art.

(Continued)

*Primary Examiner* — Gregory Huson
*Assistant Examiner* — Daniel E Namay
(74) *Attorney, Agent, or Firm* — David G. Woodral; GableGotwals

(57) ABSTRACT

A device has a platform with an upward facing receptacle therein. A base supports the platform at a predetermined height and a fuel burning insert is removably retained in the upward facing receptacle by retention means affixed to the receptacle. The fuel burning insert provides for combustion of liquid fuel proximate the predetermined height of the platform. The fuel burning insert may be removed, exchanged, and refilled by a user without tools.

20 Claims, 6 Drawing Sheets

(51) Int. Cl.
*F24C 15/08* (2006.01)
*F23D 3/24* (2006.01)

(56) References Cited

U.S. PATENT DOCUMENTS 203,043 A 4/1878 Hillegass
493,341 A * 3/1893 Purdy ..... F23D 14/28 431/343
510,235 A * 12/1893 Blits ..... A61H 33/12 126/257
556,286 A 3/1896 Schlicht
611,509 A * 9/1898 Randleff ..... F24C 5/00 126/259 R
613,188 A 10/1898 Cadwallader et al.
614,100 A * 11/1898 Griffiths ..... F23D 14/28 431/343
670,301 A * 3/1901 Solosth ..... F23D 3/00 431/102
747,529 A * 12/1903 Allan ..... F24C 5/00 126/259 R
772,249 A * 10/1904 McLewee ..... F24C 5/00 126/259 R
869,049 A * 10/1907 Birch ..... F23D 14/28 362/107
1,079,281 A * 11/1913 Ackroyd ..... F21V 37/00 431/298
1,096,066 A * 5/1914 Stevenson ..... F23Q 2/02 431/321
1,096,185 A * 5/1914 Nelson ..... F24C 3/14 126/246
1,292,316 A * 1/1919 Hoffman ..... F24C 5/04 126/96
1,310,830 A * 7/1919 Mothersall ..... F24C 5/20 126/43
1,389,841 A * 9/1921 Pearson ..... F24C 5/12 126/96
1,403,089 A 1/1922 Lloyd et al.
1,554,130 A 9/1925 Sargeant
1,634,443 A 7/1927 Bennett
1,705,877 A 3/1929 Ramsey
1,732,708 A 10/1929 Withrow et al.
2,122,624 A 7/1938 Sauer
2,182,143 A 12/1939 Campbell
2,217,970 A 10/1940 Shearman et al.
2,330,705 A * 9/1943 Hamblet ..... C11C 5/008 428/26
2,465,572 A * 3/1949 Bramming ..... F24C 5/20 126/38
2,482,797 A 9/1949 Quinnell et al.
2,642,744 A * 6/1953 Thomas ..... G01F 19/00 126/30
2,669,117 A * 2/1954 Fuhrmann ..... E04G 21/00 108/101
2,684,182 A 7/1954 Gey
2,728,846 A 12/1955 Prickett et al.
2,744,809 A 5/1956 Falligant
2,817,226 A 12/1957 Dickman
2,836,043 A 5/1958 Spethmann
3,154,065 A 10/1964 Bencoe
3,161,357 A * 12/1964 Hart ..... F21S 13/12 362/414
3,225,756 A 12/1965 Bencoe
3,270,192 A 8/1966 Watson
3,364,704 A 1/1968 Bernstein
3,540,429 A * 11/1970 Klas ..... A47J 36/24 126/92 B
3,721,516 A 3/1973 Reese
3,994,672 A * 11/1976 Novak ..... F23D 3/02 431/320
4,022,567 A 5/1977 Miyahara
4,113,421 A 9/1978 Miyahara
D262,999 S 2/1982 Spencer
4,477,247 A 10/1984 Kumasaka
D286,682 S 11/1986 Greenlee
4,728,286 A 3/1988 Olsen
4,734,833 A 3/1988 Schneeberger
4,907,964 A * 3/1990 Howarth ..... F23G 7/08 431/202
5,083,916 A 1/1992 Glennon et al.
5,101,328 A 3/1992 Hai
5,205,730 A 4/1993 Capdeville
5,744,106 A 4/1998 Eagle
5,807,093 A 9/1998 Tendick, Sr.
D404,507 S 1/1999 Palmer et al.
5,902,101 A 5/1999 Palmer et al.
5,938,430 A 8/1999 Majerowski
6,039,464 A * 3/2000 Esprit ..... B63B 45/02 362/159
D433,763 S 11/2000 Donato
6,231,336 B1 5/2001 Chen
6,250,912 B1 * 6/2001 Widdowson ..... F23D 3/24 248/312.1
6,345,978 B1 2/2002 Lu
D456,917 S 5/2002 Kumar
6,428,311 B1 8/2002 Bernardo
D470,962 S 2/2003 Chen
6,514,070 B2 2/2003 Lu
D473,669 S 4/2003 Hille et al.
6,562,302 B1 5/2003 Hooks, II
6,565,012 B1 5/2003 Zaragoza et al.
6,612,720 B1 9/2003 Beadle
6,663,258 B1 12/2003 Kanter
6,666,205 B1 * 12/2003 Guo ..... F24C 3/082 126/248
D495,079 S 8/2004 Mullen
7,073,920 B2 7/2006 Konkle, Jr. et al.
7,083,409 B2 8/2006 Kuelbs et al.
7,156,653 B1 1/2007 DeMars
7,168,426 B1 * 1/2007 Hsu ..... A47J 36/26 126/256
D575,893 S 8/2008 Castellucci et al.
D589,188 S 3/2009 Sabernig
D591,896 S 5/2009 Plonski et al.
D611,637 S 3/2010 Sabernig
D611,640 S 3/2010 Sabernig
D625,850 S 10/2010 Lu
7,973,920 B2 7/2011 Nakano et al.
8,001,956 B1 * 8/2011 Bourgeois ..... F24C 3/14 126/30
D659,871 S 5/2012 Lee et al.
8,550,813 B2 10/2013 Masterson et al.
8,991,382 B1 * 3/2015 Mau ..... F24B 1/181 126/25 R
9,797,557 B2 * 10/2017 White ..... F21L 27/00
9,890,950 B2 * 2/2018 Masterson ..... F23D 3/18
2001/0053504 A1 12/2001 Lu
2002/0080604 A1 6/2002 Niermann
2002/0102509 A1 8/2002 Johnson
2002/0164554 A1 11/2002 Kisch et al.
2003/0036030 A1 2/2003 Doppelt
2003/0103354 A1 6/2003 Niermann
2005/0232808 A1 * 10/2005 Smith ..... A61L 9/03 422/5
2006/0147864 A1 7/2006 Donley
2006/0199129 A1 9/2006 Konkle, Jr.
2006/0236996 A1 * 10/2006 Mosher, II ..... F24B 3/00 126/30
2006/0251997 A1 11/2006 Schulte et al.
2007/0015097 A1 * 1/2007 Baker ..... F23D 3/18 431/320
2007/0020572 A1 1/2007 Furner et al.
2007/0111149 A1 5/2007 Matsuyama
2007/0169409 A1 7/2007 Chang
2007/0190471 A1 8/2007 Lin
2009/0068608 A1 3/2009 Hansen
2009/0208890 A1 8/2009 Chang
2009/0220904 A1 9/2009 Masterson et al.
2009/0291400 A1 * 11/2009 Levy ..... A61L 9/037 431/120
2010/0112503 A1 5/2010 Masterson
2010/0215549 A1 8/2010 Corda

(56) References Cited

U.S. PATENT DOCUMENTS

| | | | | |
|---|---|---|---|---|
| 2010/0255436 | A1 | 10/2010 | Lu | |
| 2010/0315022 | A1 | 12/2010 | Schnitzer | |
| 2011/0097676 | A1 | 4/2011 | Masterson et al. | |
| 2011/0239539 | A1 | 10/2011 | Gatt | |
| 2013/0027918 | A1* | 1/2013 | White | F23D 3/18 362/157 |
| 2013/0129571 | A1 | 5/2013 | Chiu | |
| 2013/0160759 | A1* | 6/2013 | Yen | F24C 3/14 126/91 A |
| 2013/0330678 | A1 | 12/2013 | Chen | |
| 2015/0034066 | A1* | 2/2015 | Plott | A47J 37/0713 126/25 R |
| 2015/0083116 | A1* | 3/2015 | Zhu | F24C 3/14 126/91 A |
| 2016/0281945 | A1* | 9/2016 | White | F21L 27/00 |

FOREIGN PATENT DOCUMENTS

| | | | | |
|---|---|---|---|---|
| CN | 201014219 | | 1/2008 | |
| CN | 201348155 | | 11/2009 | |
| DE | 3541215 | A1 * | 5/1987 | F21S 10/02 |
| FR | 2745362 | | 8/1997 | |
| WO | WO03106895 | | 12/2003 | |

OTHER PUBLICATIONS

European Patent Office, "Extended European Patent Search for European Patent Application No. 13165624.1", dated Jul. 25, 2013, Published in: NL.

Pipe-Line Denmark, "The Torch Master Brochure", Publisher: http://www.pipe-line.dk/pdf/English2007WEB.pdf. Publication unknown, admitted prior art.

* cited by examiner

TORCH WITH ELEVATED PLATFORM

FIELD OF THE INVENTION

This disclosure relates to fuel burning torches generally and, more particularly, to a fuel burning torch with an elevated platform.

BACKGROUND OF THE INVENTION

Liquid fueled torches are utilized for a number of purposes such as lighting, decoration, and pest repellence. Torches may have increased visibility or utility if they are elevated above the underlying support surface.

What is needed is a system for addressing the above, and related, issues.

SUMMARY OF THE INVENTION

The invention of the present disclosure, in one aspect thereof, comprises a device having a platform with an upward facing receptacle therein. A base supports the platform at a predetermined height and a fuel burning insert is removable retained in the upward facing receptacle by retention means affixed to the receptacle. The fuel burning insert provides for combustion of liquid fuel proximate the predetermined height of the platform. The fuel burning insert may be removed, exchanged, and refilled by a user without tools.

In some embodiments, the platform further comprises an upper planar surface with the receptacle defined therein, the receptacle further comprising an annular floor suspended below the upper planar surface by an upper wall spanning therebetween. The receptacle may further comprise a lower wall suspended below the annular floor.

The retention means may be affixed to the lower wall and may comprise at least one gripping member. The gripping member may comprise a spring that biases against the fuel burning insert when the insert is placed into the receptacle, or it may comprise a rubber foot.

In other embodiments, the retention means comprises at least one magnet. The at least one magnet may be affixed to the annular floor such that when the fuel burning insert is ferromagnetic it will be removably retained against the annular floor.

In some embodiments, the base has a width at a lower extremity that is about 82.5 percent wider than a width of the base where it supports the platform. The base may support the platform at a height of about 28 inches. The platform may include a skirt descending from the upper planar surface to cover a portion of the base. The base may comprise a woven, fire resistant material covering an internal frame.

The fuel burning insert may comprise a fuel reservoir that is situated inside the base and below the upper planar surface when the fuel burning insert is placed in the receptacle. The fuel burning insert may also comprise a shrouded flame bowl suspended in the receptacle by a perforated support. In another embodiment, the fuel burning insert comprises a fuel canister containing a wick with a central flame opening.

The invention of the present disclosure, in another aspect thereof, comprises a device having a base having a width at a bottom end that is greater than a width at an upper end. A platform is suspended proximate the upper end of the base and defining a receptacle therein. A fuel burning insert in the receptacle has a fuel reservoir below an upper surface of the platform. The fuel burning insert is retained in the receptacle with sufficient restraint that the fuel burning insert will not be dislodged by an upset of the base but may still be removed without tools by a user.

In some embodiments, the fuel burning insert is retained by a gripping member proceeding from a vertical wall of the receptacle that is below the upper surface of the receptacle. In other embodiments, the fuel burning insert is retained by at least one magnet affixed to a horizontal shelf in the receptacle.

The invention of the present disclosure, in another aspect thereof, comprises a device with a liquid fuel burning insert comprising a fuel reservoir. A receptacle is defined in a horizontal platform that suspends the liquid fuel burning insert such that combustion of fuel takes place substantially at or above the level of the horizontal platform with the fuel reservoir substantially below the horizontal platform. The device includes a base having a taper from a bottom end to a top end, the top end fitting within the skirt of the horizontal platform and supporting the horizontal platform at a predetermined height. The receptacle allows removal of the liquid fuel burning insert by user applied traction but provides sufficient restraint of the liquid fuel burning insert such that the liquid fuel burning insert is not dislodged from the receptacle if the base overturns. In some embodiments, the horizontal platform provides a peripheral skirt that covers an upper extremity of the base.

DETAILED DESCRIPTION OF THE PREFERRED EMBODIMENTS

Figure 1:
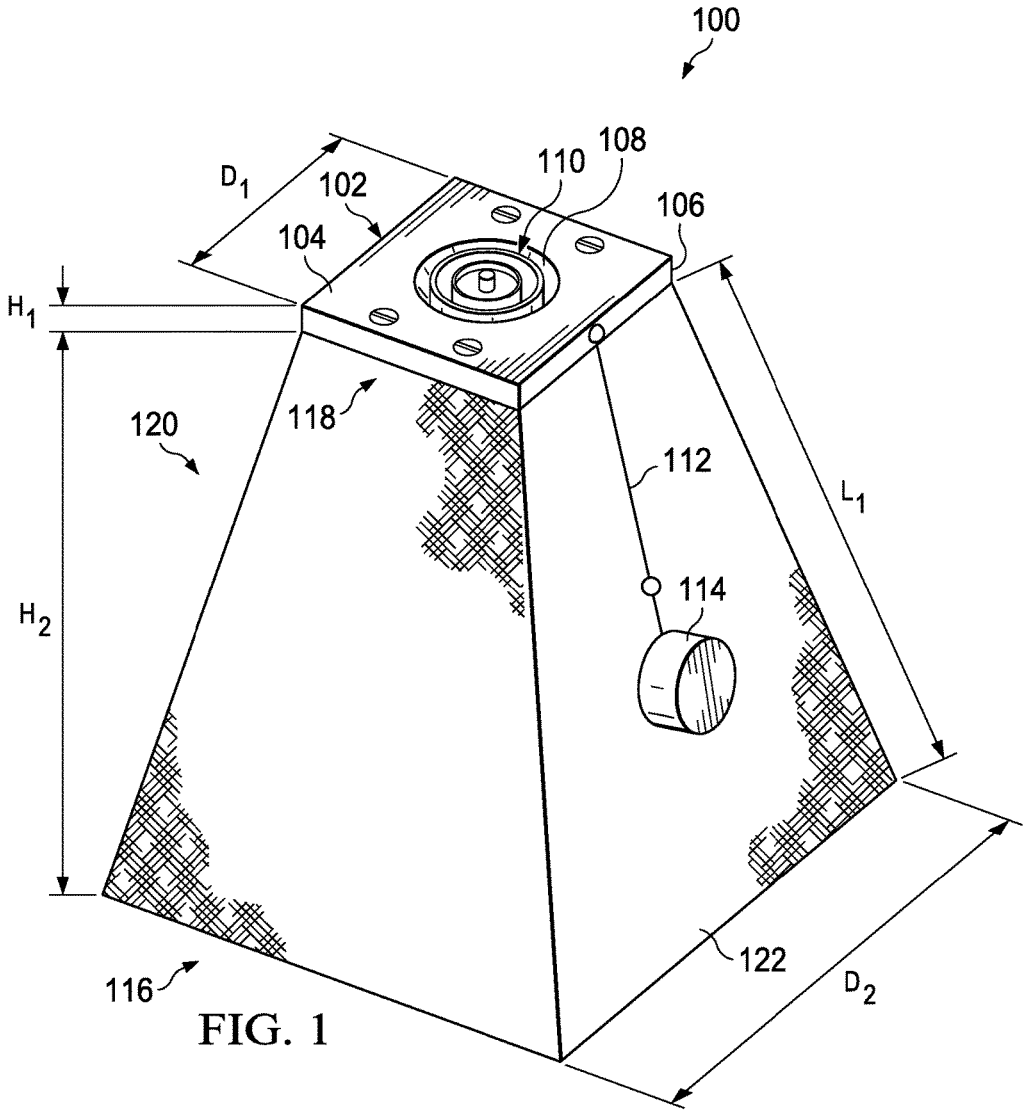
FIG. 1 is a perspective view of one embodiment of a torch with elevated platform according to aspects of the present disclosure.

Referring now to FIG. 1, a perspective view of one embodiment of a torch 100 with elevated platform 102 according to aspects of the present disclosure is shown. The platform 102 has an upper planar surface 104. The upper planar surface 104 is not necessarily completely flat but is the portion of the platform 102 that is supported in the desired elevated position by the base 120.

The planar surface 104 may be contrasted with a surrounding skirt 106, which proceeds downward from the planar surface 104 to partially surround an upper extremity 118 of the base 120. The planar surface 104 is substantially square in the present embodiment but could take on other shapes as well. The upper extremity 118 mates with the planar surface 104 and may therefore match the shape of the planar surface 104 (e.g., square, in the present embodiment).

The platform 102 may define an upwardly facing or upwardly opening receptacle 108 in the planar surface 104. The receptacle 108 receives, in a selectively removable fashion, a fuel burning insert 110. In the present embodiment, a user of the torch 100 can remove the insert 110 at will, without the need for tools by pulling or applying upward traction. Thus, the fuel burning insert 110 can be removed from the torch 100 to be refilled, replaced, or otherwise serviced. However, as described further below, the receptacle 108 provides sufficient restraint or retention of the fuel burning insert 110 such that it will not become inadvertently dislodged or removed, even if the torch 100 is overturned.

The platform 102 may have a tether 112 that retains a snuffer 114. The snuffer 114 provides a reliable and convenient method to extinguish the fuel burning insert 110 even where a large flame is provided. The snuffer 114 may be sized to fit into the receptacle 108 but down over the outside of the fuel burning insert 110. The snuffer 114 may serve as a cap or storage cover for the receptacles and/or fuel burning insert 110 when the fuel burning insert 110 is ignited.

The platform 102 may be formed from a metal alloy or other heat resistant material. As described below, in some embodiments, steps are taken to minimize heat transfer from the fuel burning insert to the platform 102. Nevertheless, a durable coating may be applied to the platform 102, such as a heat-resistant paint. The coating may also protect against oxidation of any metals used to construct the platform 102 as well as damage from spillage of fuels or other sub stances.

Dimensions of the torch 100 may vary according to embodiment. Where the platform 102 has a square planar surface 104, each side may be of approximately equal length shown as $D_1$. In the present embodiment $D_1$ is about 7.25 inches. The skirt 106 may vary in length (or amount of drop from the planar surface 104) but in the present embodiment has a length $H_1$ of about 1.375 inches. In the present embodiment, the base 120 supports the platform at a height $H_2$ of about 28 inches. Thus, the embodiment shown is sufficient to elevate the fuel burning insert 110 to slightly below waist high. This allows for better viewing, illumination, and scent dispersal (if provided) on a stable platform, among other benefits.

The base 120 may be constructed from solid walls or it may be based upon a frame and cover design as shown. The base 120 has a woven and fire resistant cover 122. The color, texture, and weave of the cover 122 can be selected for desired appearance. The platform 102 acts, in some respect, to protect the cover 122 from damage. Even if the torch 100 is overturned, the skirt 106 acts to prevent excessive damage to the cover 122.

As described in greater detail with respect to FIG. 3 below, the base 120 provides a stable support that, due to its dimensions and geometry, will resist being overturned even if bumped into. If the torch 100 is overturned, spillages are minimized and the fuel burning insert 110 protected from damage by the retention mechanisms of the receptacle 108.

Figure 2:
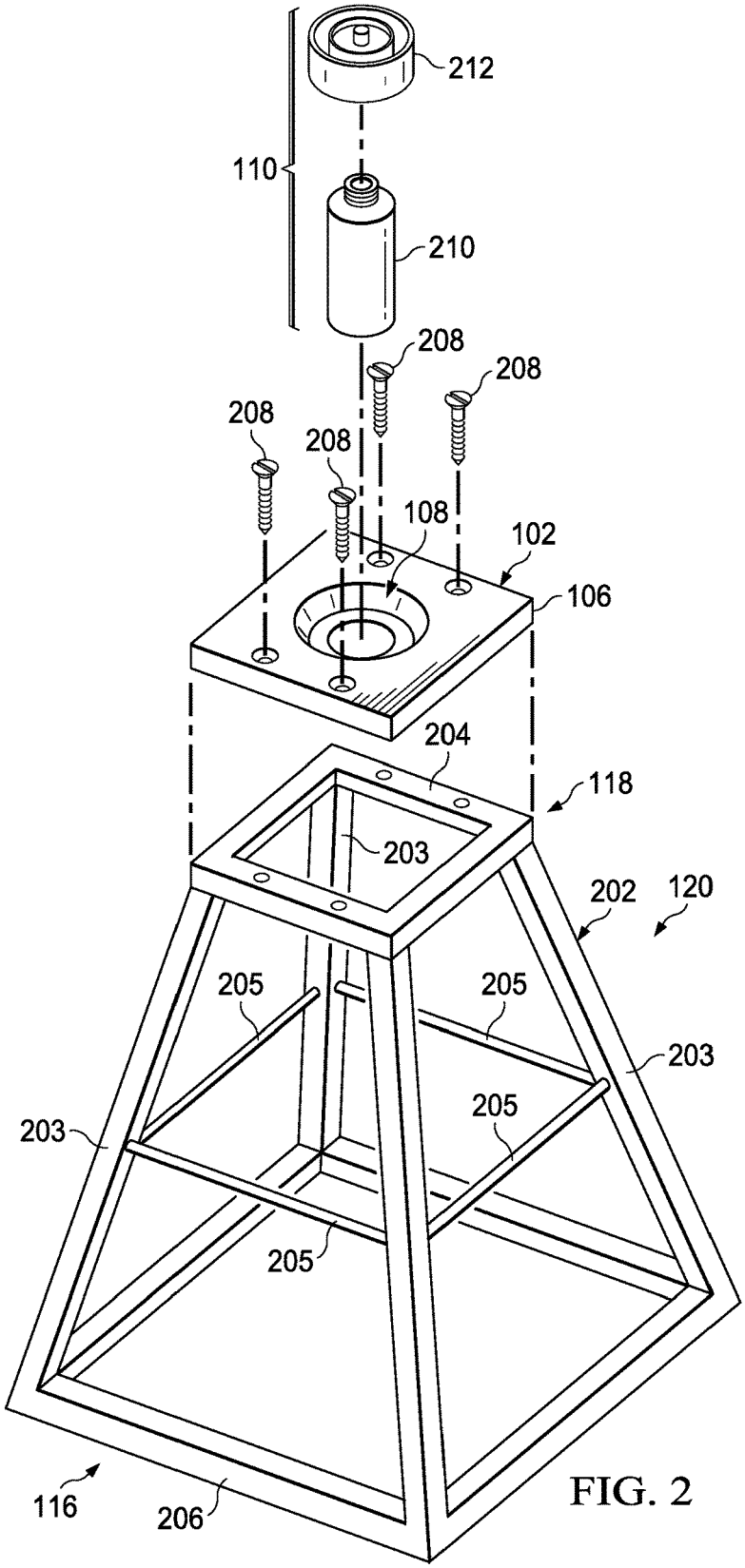
FIG. 2 is an exploded view of the torch of FIG. 1.

Referring now to FIG. 2, an exploded view of the torch 100 of FIG. 1 is shown. The cover 122 is removed from the base 120 in FIG. 2 for illustrative purposes. In the present embodiment, beneath the removed cover 122 the base 120 comprises a frame 202 having an upper subframe 204 at the upper extremity 118 and a lower subframe 206 at the lower extremity 116. The upper subframe 204 is joined to lower subframe 206 by a plurality of legs 203. In the present embodiment, there are four legs 203 corresponding to corners of substantially square shapes of the upper subframe 204 and lower subframe 206. The legs 203 and subframes 204, 206 may comprise square tubing welded together, or may be constructed of another suitably resilient material. Intermediate braces 205 may be provided for structural integrity or to support the cover 122 if or when force is applied to it. The braces 205 may be wire, square tubing, or other materials.

The platform 102 may join to the upper subframe 204 (possibly with a portion of the cover 122 interposing the platform 102 and upper subframe 204) by one or more fasteners 208, which may be screws, bolts, brads, rivets or other fasteners. The fuel burning insert 110 is shown removed from the receptacle 108 and can be seen to comprise a fuel reservoir 210 and a burner 212.

Figure 3:
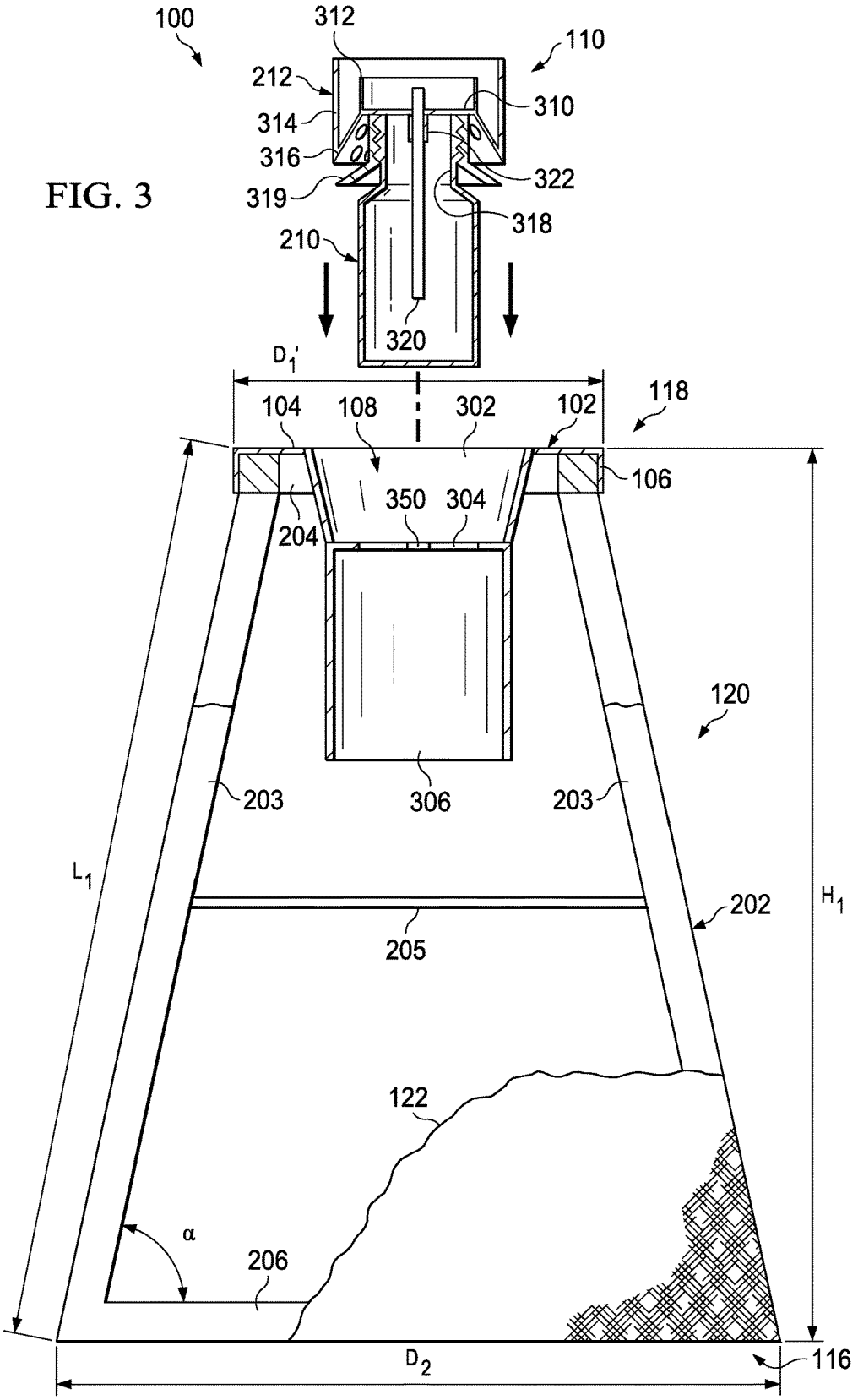
FIG. 3 is a side cutaway view of the torch of FIG. 1.

Referring now to FIG. 3, a side cutaway view of the torch of FIG. 1 is shown. The cover 122 is attached on the outside of the frame 202. The platform 102 may then be attached to the upper extremity 118 by being fastened to the upper subframe 204 with fasteners possible passing through the interposing layer of the cover 122.

A width $D_1'$ denotes a width along one side of the upper subframe 204 with the cover 122 attached (e.g., as measured outside the cover 122). In the present embodiment, $D_1'$ is about 7 inches. Thus, the platform 102 having a side width $D_1$ of about 7.25 inches easily fits over the upper extremity 118. The legs 203 are angled rather than being completely vertical but the slope is steep, ranging from about 5 degrees to about 7 degrees from vertical. Thus the illustrated angle, $\alpha$, ranges from about 83 to 85 degrees. Depending upon tolerance and materials used to construct the cover 122, the skirt 106 of the platform 102 may be vertical and still fit down over the upper extremity 118 of the base 120. However, in the present embodiment, the skirt 106 has a slight angle of about 6 degrees from vertical to substantially match the slope or contour of the base 120.

The overall height $H_1$ of the platform 102 is about 28 inches. A width D2 of the lower extremity 116 of the base may be about 13 inches. Therefore the lower extremity 116 of the base 120 is about 82.5% wider than the upper extremity 118. With a slope of about 6 degrees from vertical a length $L_1$ of the legs 203 is about 28.15 inches. Although the angle of the legs 202 is only a slight lean inward from perfectly vertical, the larger foot print of the base 120 relative to size of the platform 102 holding the burner insert 110 provides stability for the torch 102.

Being narrower at the upper extremity 118 than the lower extremity 116 also means that, for a given footprint, a user is less likely to be in close proximity to any flame or hot surfaces. Furthermore, the receptacle 108, being sized some degree smaller than the surface area of the upper planar surface 104, provides an additional separation from the sides or skirt 106 of the platform 102, which is a likely point of accidental contact with the torch 100.

In the present embodiment, the receptacle 108 comprises an upper wall 302 that is either vertical or has a slope down to an attached horizontal annular floor or shelf 304. The shelf 304 provides support for the fuel burning insert 110. The depth of the shelf 304 relative to the planar surface 104 of the platform 102 may be only slightly less than a height of the burner 212. The overall width of the receptacle 108 may be greater than that of the burner 212 such that there is a degree of isolation between the burner 212 and the planar surface 104. This also allows for easy insertion of the snuffer (114, FIG. 1) down into the receptacle 108 but over the burner 212 to extinguish flames. In cases where the depth of the shelf 304 is slightly less than the height of the burner 212, the snuffer may be easily removed even where there is little clearance between the snuffer 114 and the walls 302.

Below the shelf 304 is a vertical wall 306 that may be cylindrical in shape. This provides guidance for the fuel reservoir 210 of the fuel burning insert 110 as it is inserted into or removed from the receptacle 108.

The fuel burning insert 110 may be removed from the receptacle 108 (or reinserted) without tools, even though the receptacle provides for secure retention of the fuel burning insert 110. Various automatically deployed retention means may be utilized to accomplish this. In other words, by the act of insertion of the fuel burning insert 110, it will also be securely affixed such that even an overturn of the torch 100 will not dislodge it. Furthermore, the fuel burning insert 110 can just as easily be removed. In the embodiment shown in FIGS. 1-4, the retention means is one or more magnets 350.

Figure 4:
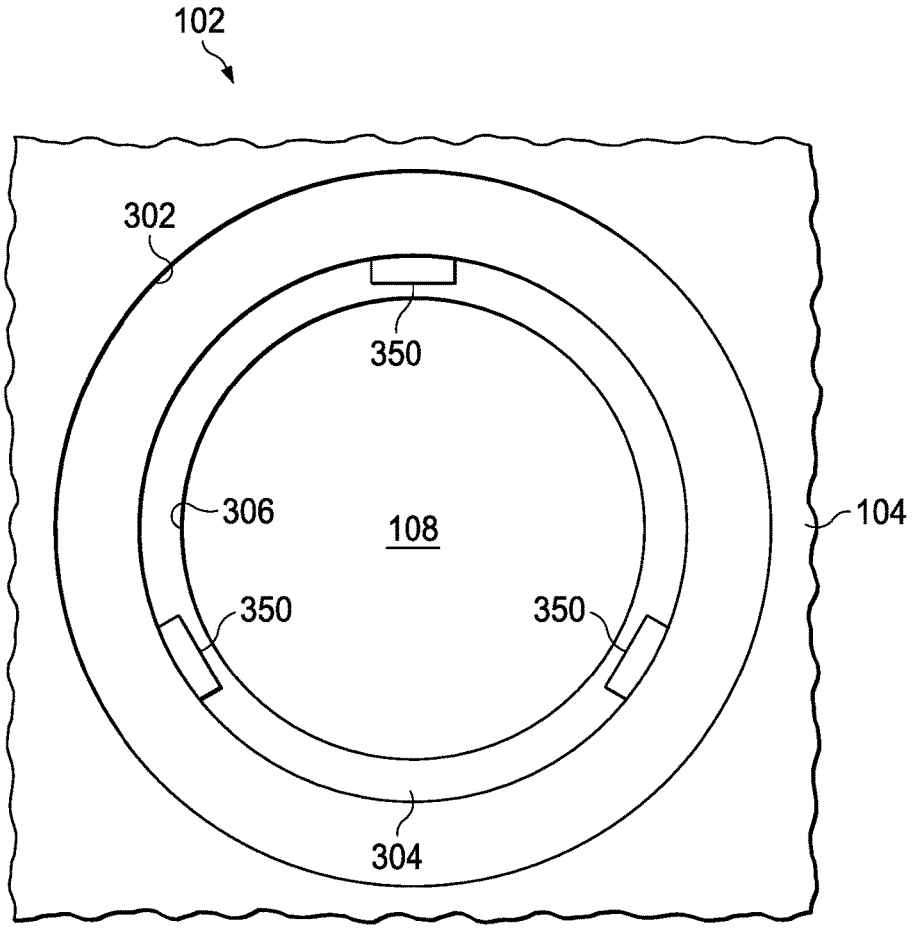
FIG. 4 is a plan view of one embodiment of a torch platform according to aspects of the present disclosure.

Referring now also to FIG. 4, a plan view corresponding to the platform 102 of the torch 100 of FIGS. 1-3 is shown. Here, there is a plurality of magnets 350 imbedded in, or otherwise affixed to, the shelf 304. When the burner 212 of the fuel burning insert 110 is placed on or near the shelf 304 magnetic attraction (when the burner 212 comprises a ferromagnetic material) will attract and retain the burner 212 securely in place. The location and strength of the magnets 350 may be selected such that, even where the fuel reservoir 310 is full, gravity or nominal impact forces (e.g., as from an overturn of the torch 100) cannot dislodge the fuel burning insert 110. However, the user should be able to lift the fuel burning insert 110 (when extinguished and cooled of course) free of the receptacle. This allows for refilling, replacement, or other servicing of the fuel burning insert 110.

With continued reference to FIG. 3, the fuel burning insert 110 can be seen to comprise the burner 212 detachably fitted to the fuel reservoir 210. The burner 212 comprises a large flame bowl 310 surrounding a wick holder 322 containing a wick 320. The wick 320 may be a permanent type fiberglass wick. The flame bowl 310 may be described as "large" as it is approximately three times in diameter the diameter of the wick 320. This provides for a larger and more pleasing flame. Moreover, any scents or repellants dispersed by the flame will have greater efficacy. The flame bowl 310 may have a shroud 312 surrounding it. In some cases, the shroud 312 is substantially vertical. The shroud may deviate slightly from vertical in some instances. The shroud 312 can also be an integral extension of the sides of the flame bowl 310.

A fitting 318 affixes to an underside of the flame bowl 310 for attaching the fuel reservoir 210. The fitting 318 may be a traditional threaded fitting and may also have an outer flared portion 319 for guiding the fuel reservoir 210 into the fitting 318 when being reattached.

Affixed to the underside of the flame bowl 310, outside of the wick holder 322 and fuel reservoir fitting 318 is a support member 316. The support member 316 suspends and properly locates the flame bowl 310 within the receptacle 108 when the fuel burning insert 110 is inserted therein. The support member 316 may be perforated in order to slow heat transfer from the flame bowl 310 to the platform 102.

Spaced apart from the shroud 312 (which may be called an inner shroud) and flame bowl 310 an outer shroud 314 ascends substantially vertically from the support 316. The shrouds 312, 314 may terminate at approximately the same upper level. In some embodiments, the inner shroud 312 has a diameter of about 2.5 inches while the outer shroud has a diameter of about 3.5 inches. Thus, if the shrouds 312, 314 are concentric and, depending upon thickness, about 0.5 inches of space should remain therebetween. This provides for some cooling of the support member 316 and further isolates heat from the flame bowl 310 from being transferred to the platform 102. It will also be appreciated that both the inner shroud 312 and outer shroud 314 serve as a barrier against radiant heat transfer from the combusting fuel to the platform 102.

Figure 5:
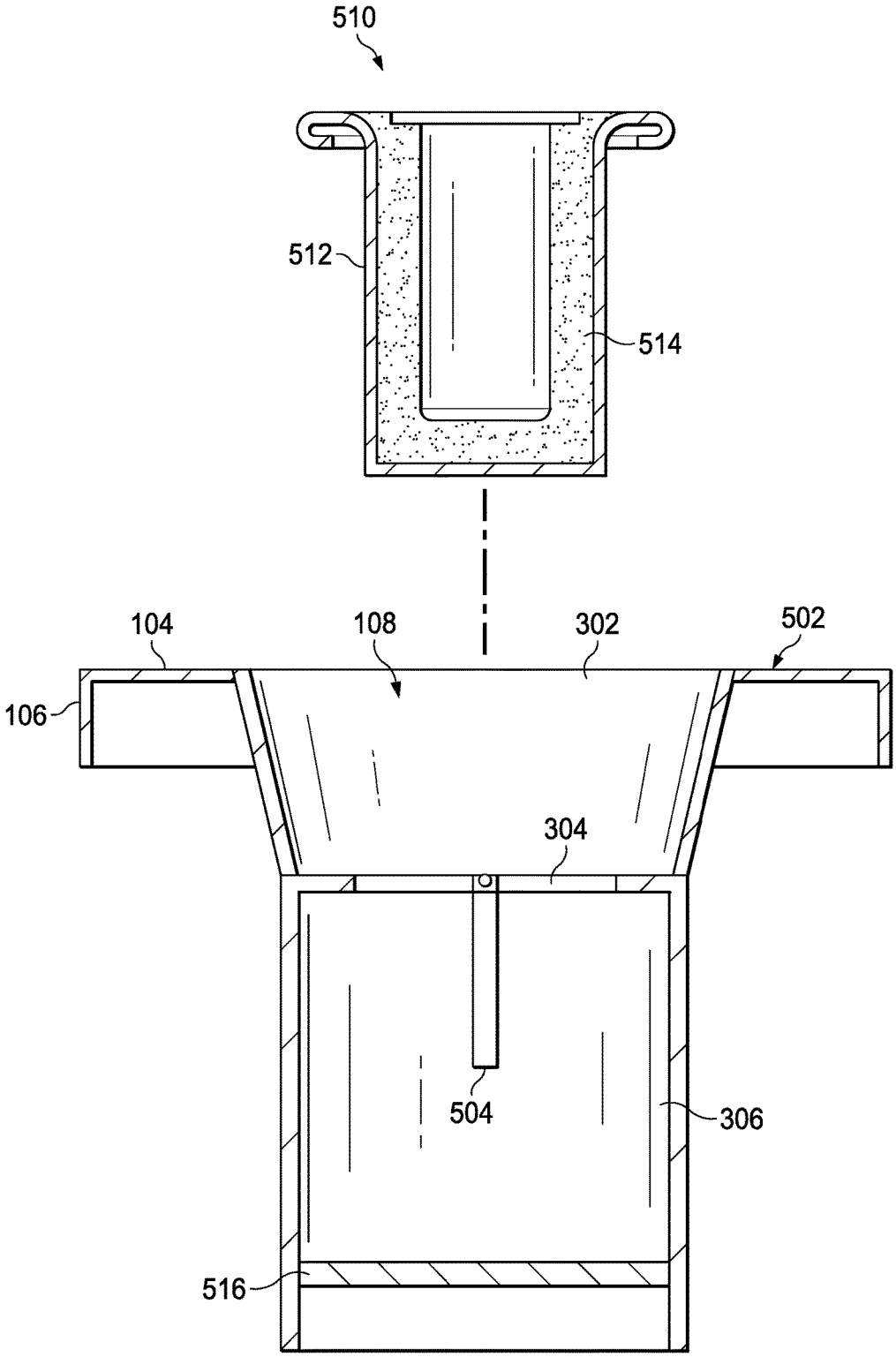
FIG. 5 is a side cutaway view of another embodiment of a torch platform according to aspects of the present disclosure.
Figure 6:
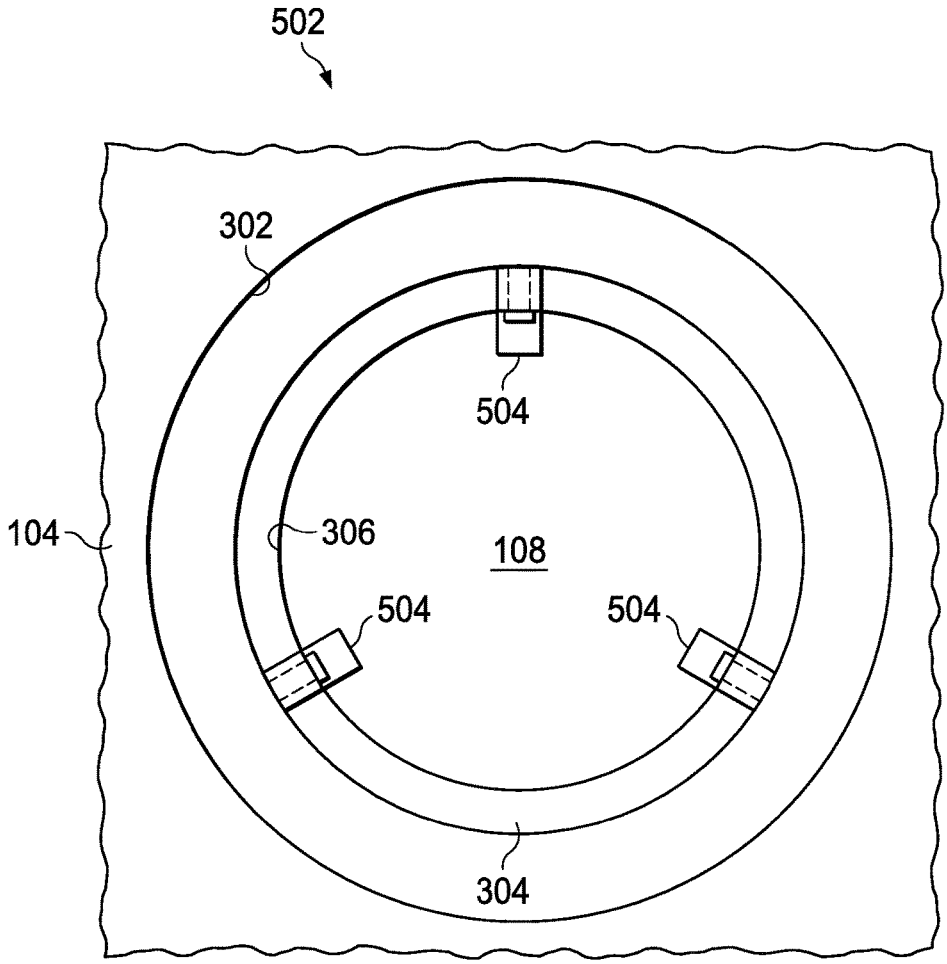
FIG. 6 is a plan view of the torch platform of FIG. 5.

Referring now to FIG. 5, a side cutaway view of another embodiment of a torch platform 502 according to aspects of the present disclosure is shown. FIG. 6 is a plan view of the torch platform 502. The platform 502 may be substituted for the platform 102 previously described and is substantially similar except for differences noted below.

The platform 502 features a different retention means from the platform 102. The platform 502 utilizes one or more gripping members 504. In FIGS. 5-6 the gripping members 504 are spring steel arranged to bow inward toward the center of the cylindrical wall 306. The gripping members 504 may be riveted to the shelf 304 and bent downward to form a bow into the center of cylindrical wall 306. In other embodiments, the gripping members 504 may affixed directly to the wall 306. In further embodiments, the gripping members 504 may be formed from cutout and bent portions of the wall 306 itself. Although, in the present embodiment, the gripping members 504 are springs, other gripping members could be utilized such as rubber feet that affix to the shelf 304 and/or wall 306 and project toward the center of the cylindrical wall 306.

In the present embodiment, a different fuel burning insert 510 is shown as well. The fuel burning insert 510 may comprise a canister 512 that functions as the wick holder and the fuel reservoir. The wick 514 may have a hollow center portion from which flames are emitted when lit. In this respect, the fuel burning insert 510 is substantially similar to a burner cup such as described in U.S. Patent Application Publication No. 2015/0049470 for BURNER CUP, herein incorporated by reference. Various fuels may be used with the fuel burning insert 510. One suitable fuel is disclosed by US Patent Application Publication No. 2015/0153038 for METHYL ESTER TORCH FUEL, herein incorporated by reference. Another suitable fuel is disclosed by US Patent Application Publication No. 2015/0276216 for PALM KERNEL METHYL ESTER TORCH FUEL, herein incorporated by reference.

The fuel burning insert 510 may be inserted into the receptacle 108 such that the canister 512 occupies a portion of the area inside the cylindrical wall 306. The gripping members 504 engage the canister 512 and retain it securely. As with previous embodiments, the canister 512 is retained sufficiently that neither gravity nor impact from overturning the torch 100 will dislodge the fuel burning insert 510. However, also as with previous embodiments, a user can remove the fuel burning insert 510 without tools, and using only a reasonable amount of force. In the present embodiment, the fuel burning insert 510 need not be ferromagnetic as the gripping members 504 do not rely upon magnetism to operate.

In order to prevent over insertion of the fuel burning insert 510, a stop 516 may be placed at an appropriate location along the cylindrical wall 306 below the shelf 304. In the present embodiment, the stop 516 comprises a steel bar. However, the stop 516 could also take the form of a shelf or lip, either on the wall 306, or on the canister 512.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

For purposes of the instant disclosure, the term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising of two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

* * *

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A device comprising:

a horizontal platform with an upper planar surface having an upward facing receptacle therein;

a base supporting the platform at a predetermined height; and a fuel burning insert removably retained in the upward facing receptacle by retention means affixed to the receptacle;

wherein the fuel burning insert provides for combustion of liquid fuel proximate the predetermined height of the platform;

wherein the fuel burning insert may be removed, exchanged, and refilled by a user without tools.

2. The device of claim 1, wherein receptacle further comprises an annular floor suspended below the upper planar surface by an upper wall spanning therebetween.

3. The device of claim 2, wherein the receptacle further comprises a lower wall suspended below the annular floor.

4. The device of claim 3, wherein the retention means is affixed to the lower wall.

5. The device of claim 4, wherein the retention means comprises at least one gripping member.

6. The device of claim 5, wherein the gripping member comprises a spring that biases against the fuel burning insert when the insert is placed into the receptacle.

7. The device of claim 6, wherein the gripping member comprises a rubber foot.

8. The device of claim 2, wherein the retention means comprises at least one magnet.

9. The device of claim 8 wherein the at least one magnet is affixed to the annular floor such that when the fuel burning insert is ferromagnetic it will be removably retained against the annular floor.

10. The device of claim 2, wherein the base has a width at a lower extremity that is about 82.5 percent wider than a width of the base where it supports the platform.

11. The device of claim 10, wherein the base supports the platform at a height of about 28 inches.

12. The device of claim 2, wherein the platform further comprises a skirt descending from the upper planar surface to cover a portion of the base.

13. The device of claim 2, wherein the fuel burning insert comprises a fuel reservoir that is situated inside the base and below the upper planar surface when the fuel burning insert is placed in the receptacle.

14. The device of claim 1, wherein the base further comprises a woven, fire resistant material covering an internal frame.

15. The device of claim 1, wherein the fuel burning insert comprises a shrouded flame bowl suspended in the receptacle by a perforated support.

16. The device of claim 1, wherein the fuel burning insert comprises a fuel canister containing a wick with a central flame opening.

17. A device comprising:

a base having a width at a bottom end that is greater than a width at an upper end;

a horizontal platform with an upper square, planar surface suspended proximate the upper end of the base and defining a receptacle therein; and a fuel burning insert in the receptacle having a fuel reservoir below an upper surface of the platform;

wherein the fuel burning insert is retained in the receptacle with sufficient restraint that the fuel burning insert will not be dislodged by an upset of the base but may still be removed without tools by a user.

18. The device of claim 17, wherein the fuel burning insert is retained by a gripping member proceeding from a vertical wall of the receptacle that is below the upper surface of the receptacle.

19. The device of claim 17, wherein the fuel burning insert is retained by at least one magnet affixed to a horizontal shelf in the receptacle.

20. A device comprising:

a liquid fuel burning insert comprising a fuel reservoir;

a receptacle defined in a horizontal platform with an upper, planar surface that suspends the liquid fuel burning insert such that combustion of fuel takes place substantially at or above the level of the upper, planar surface with the fuel reservoir substantially below the upper, planar surface; and a base having a taper from a bottom end to a top end, the top end fitting within a peripheral skirt of the horizontal platform and supporting the horizontal platform at a predetermined height;

wherein the receptacle allows removal of the liquid fuel burning insert by user applied traction but provides sufficient restraint of the liquid fuel burning insert such that the liquid fuel burning insert is not dislodged from the receptacle if the base overturns.

* * * * *